United States Patent [19]

Capes et al.

[11] Patent Number: 4,998,624

[45] Date of Patent: Mar. 12, 1991

[54] METHOD OF SEPARATING CARBONACEOUS COMPONENTS FROM PARTICULATE COAL CONTAINING INORGANIC SOLIDS AND APPARATUS THEREFOR

[75] Inventors: C. Edward Capes, Ottawa; Richard D. Coleman; Joseph L. S. Croteau, both of Orleans; William L. Thayer, Ottawa, all of Canada

[73] Assignee: Canadian Patents and Development Limited, Ottawa, Canada

[21] Appl. No.: 437,763

[22] Filed: Nov. 16, 1989

Related U.S. Application Data

[62] Continuation of Ser. No. 865,662, May 22, 1986, abandoned.

[30] Foreign Application Priority Data

May 30, 1985 [CA] Canada ..... 482843

[51] Int. Cl.[5] ..... B03D 1/02

[52] U.S. Cl. ..... 209/5; 209/166

[58] Field of Search ..... 209/5, 166, 167, 49; 44/51

[56] References Cited

U.S. PATENT DOCUMENTS

| | | | |
|---|---|---|---|
| 1,667,277 | 4/1928 | Wilkensen | 209/5 |
| 3,665,066 | 5/1972 | Capes | 208/426 |
| 3,856,668 | 12/1974 | Shubert | 209/5 |
| 4,089,776 | 3/1978 | McMurray | 209/5 |
| 4,268,379 | 3/1981 | Paulos | 209/5 |
| 4,270,926 | 6/1981 | Burk | 209/5 |
| 4,272,250 | 6/1981 | Burk | 209/166 |
| 4,426,282 | 1/1984 | Aunsholt | 209/167 |
| 4,448,584 | 3/1984 | Masologites | 209/5 |
| 4,601,729 | 7/1986 | Capes | 44/53 |

FOREIGN PATENT DOCUMENTS

| | | | |
|---|---|---|---|
| 21778 | 1/1981 | European Pat. Off. . | |
| 1114820 | 3/1968 | United Kingdom | 209/166 |
| 2143155 | 2/1985 | United Kingdom | 209/166 |

OTHER PUBLICATIONS

"Answers to Questions on the Flotation of Ores", by O. Ralston, Dep't. of the Interior-1917, pp. 8-9.

"Process for the Wet Mechanical Separation of Raw Materials", Aug. Goette 5/20/39-Alien Property Custodian, #274857.

*Primary Examiner*—David L. Lacey

*Assistant Examiner*—Thomas M. Lithgow

*Attorney, Agent, or Firm*—Griffin, Branigan & Butler

[57] ABSTRACT

Carbonaceous components are separated from particulate coal containing inorganic solids by agitating and aerating the coal, agglomerating oil and water to form agglomerates of carbonaceous components of the coal and oil with air trapped in the agglomerates. The air trapped in the agglomerates makes them buoyant so that they collect at the surface of the water, for easy removal, while inorganic residual solids collect at the bottom of the water. The inorganic solids containing coal comprise previously formed agglomerates which are broken down by the agitation to form a slurry. In the latter case the process is for removal of inorganic solids which were not removed during the initial agglomeration. The agitation may be accomplished by a stirrer, impeller or a pump.

2 Claims, 2 Drawing Sheets

METHOD OF SEPARATING CARBONACEOUS COMPONENTS FROM PARTICULATE COAL CONTAINING INORGANIC SOLIDS AND APPARATUS THEREFOR

This application is a continuation of Ser. No. 865,662, filed May 22, 1986, now abandoned.

This invention relates to a method of separating carbonaceous components from particulate coal containing inorganic solids containing, and apparatus therefor.

It has already been proposed in U.S. Pat. No. 3,665,066, dated May 23, 1972, "Beneficiation of Coals", C. E. Capes et al, to add a bridging liquid to an aqueous, clay containing slurry of coal fines, then agitate the resultant mixture to form coal agglomerates dispersed in a slurry of the residual clay and ash impurities, and then separate the coal agglomerates by skimming them through an overflow spout in a float-sink tank. The separation of the coal agglomerates may be assisted by introducing a multitude of air bubbles at the bottom of the float sink tank.

While the separation process taught by Capes et al has proved to be useful, it would be desirable to provide a process wherein:

(i) there is no need for a float sink tank, (ii) the agglomerates themselves are rendered more buoyant and are thus rendered much more easily to separate from the residue slurry, and (iii) where agglomerates have already been formed, as taught by Capes et al, they are broken down and reformed to release ash trapped therein and render them more buoyant for ease of separation from a slurry of the ash.

According to the present invention there is provided a method of separating carbonaceous components from particulate coal containing inorganic solids, comprising:

(a) agitating previously formed, inorganic solids reduced, coal/oil agglomerates of the particulate coal in water to form an aqueous slurry of dispersed particles of the particulate coal and then, intimately mixing therewith agglomerating oil and air with the dispersed particles until robust, dense buoyant agglomerates are formed, consisting of carbonaceous coal particles, agglomerating oil and trapped air, which accumulate at the surface of newly released particulate, inorganic solids of the coal, and water, and then (b) separating the agglomerates from the residue.

Preferably, at least 0.3 weight % of agglomerating oil is added to the aqueous slurry based on the weight of the solids content of the slurry.

In some embodiments of the present invention water is removed by a screened, dewatering vacuum filter from the agglomerates which have been separated from the residue.

In some embodiments of the present invention a frothing agent is added to the aqueous slurry.

In some embodiments of the present invention a conditioning agent for increasing the oil wetability of the coal is added to the slurry.

Further, according to the present invention there is provided a carbonaceous component separating apparatus, for separating carbonaceous components from particulate coal containing inorganic solids, comprising:

(a) a container for a slurry of the coal and agglomerating oil, and (b) means for agitating and intimately mixing the coal, and the oil, and air to form agglomerates from carbonaceous portions of the coal and oil with air trapped in them.

In some embodiments of the present invention the agitating means is in the form of an impeller assembly and comprises an impeller, an impeller shaft with the impeller mounted on a lower end thereof, an air conduit coaxial with and outwardly spaced from the shaft and sealed at an upper end to the shaft for the shaft to rotate therein, air inlet means to an upper end portion of the conduit, a cylindrical casing around the impeller, the casing having an upper, annular-shaped, agglomerate inlet extending around the exterior of a lower, air outlet end of the conduit, and a plurality of arcuate, agglomerate outlets around the casing and spaced radially outwardly from the impeller for agglomerates formed by the impeller, with air trapped in them, to be centrifugally ejected therethrough.

In the accompanying drawings which illustrate, by way of example, embodiments of the present invention, FIG. 1 is a schematic side view of an apparatus for separating carbonaceous components from particulate coal containing inorganic solids;

Figure 1:
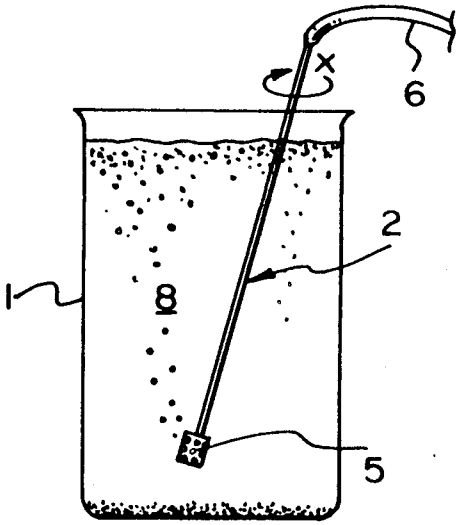

Referring now to FIG. 1 there is shown a beaker 1 and a stirrer, generally designated 2. The stirrer comprises a glass tube 4, a porous, sintered glass tip 5 fused to the lower end of the glass tube 4, and a flexible tube 6 for connection to a pressurized air supply (not shown).

When the apparatus shown in FIG. 1 was used to verify the present invention, an aqueous slurry 8 of particulate, inorganic solids containing, coal was poured into the beaker 1 together with agglomerating oil. Pressurized air was fed along the tube 6 and emitted from the tip 5 as fine bubbles which rose up through the slurry 8. The tube was rapidly stirred in the direction X and agglomerates of the carbonaceous portion of the coal and oil were formed with air trapped in them. The trapped air gave the agglomerates sufficient buoyancy for them to rise and collect at the surface of the water where they could easily be removed. Ash residue from the coal was found to settle at the bottom of the water.

Figure 2:
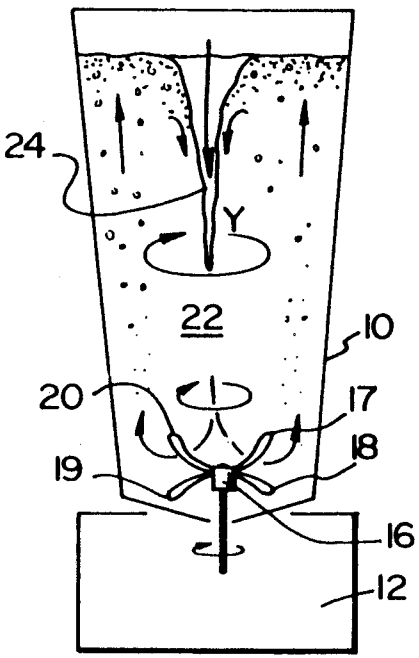
FIG. 2 is a similar view to FIG. 1, but of a different apparatus.

Referring now to FIG. 2, there is shown a conventional blender mixing cup 10 and base 12 containing a motor drive for an impeller shaft 14 rotatably sealed to and extending through the base of, the cup 10. An impeller generally designated 16 has blades 17 to 20 shaped for drawing air to form an air vortex in, and aerating, and agitate, a slurry in the cup 10.

When the apparatus shown in FIG. 2 was used to verify the present invention, an aqueous slurry 22 of particulate, inorganic solids containing, coal was poured into the cup 10. The impeller 16 was then rapidly rotated in the direction of arrow Y to form an air vortex 24 in, and aerate, and agitate, the slurry 22. Agglomerates of the carbonaceous portion of the coal and oil were formed with air trapped in them. The trapped air gave the agglomerates sufficient buoyancy for them to rise and collect at the surface of the water where they could easily be removed. Ash residue from the coal was found to collect in a lower portion of the water.

Figure 3:
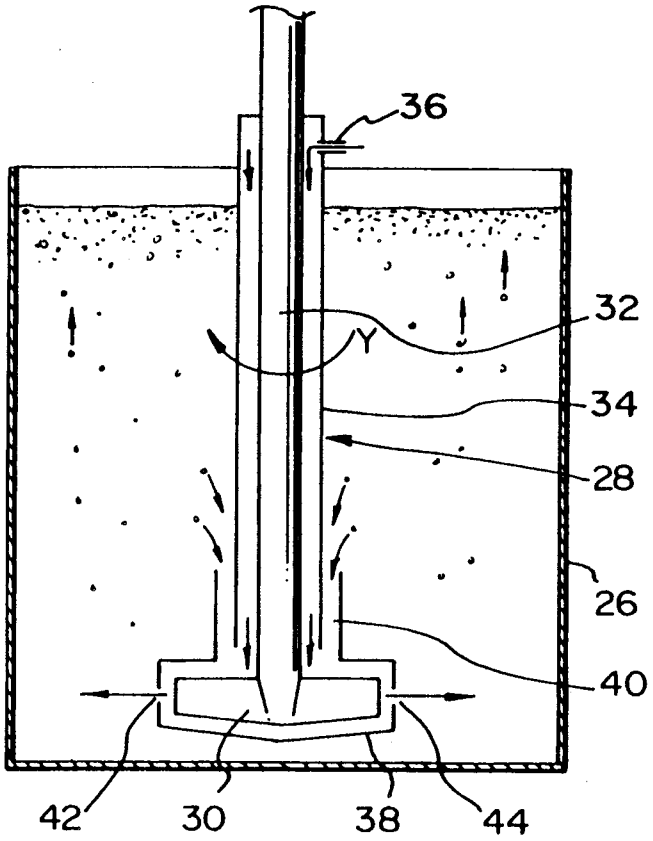
FIG. 3 is also a similar view to FIG. 1, but of yet another, different apparatus.

Referring now to FIG. 3, there is shown a container 26 and an impeller assembly generally designated 28. The impeller assembly 28 comprises an impeller 30, an impeller shaft 32, with the impeller 30 mounted on a lower end thereof, an air conduit 34 coaxial with and spaced outwardly from the shaft 32 and sealed at the upper end to the shaft 32 for the shaft 32 to rotate therein, air inlet means 36 to an upper end portion of the conduit 34, and a cylindrical casing 38 around the impeller 30, the casing 38 having an upper annular-shaped agglomerate inlet 40 extending around the exterior of lower, air outlet end of the conduit 34 and a plurality of arcuate, agglomerate outlets, such as outlets 42 and 44, around the casing and spaced radially outwardly from the impeller 30 for agglomerates formed by the impeller 30 with air trapped in them to be ejected centrifugally therethrough.

When the apparatus shown in FIG. 3 was used to verify the present invention, previously formed coal/oil agglomerates and water were poured into the container 26 together with agglomerating oil. Pressurized air was fed to the inlet 36 from a source (not shown) and the shaft 32 was rotated in the direction of arrow Y. The previously formed coal/oil agglomerates and water were drawn by the impeller 30 into inlet 40 where the agglomerates were broken down and carbonaceous portions of the coal and oil reformed as newly formed agglomerates with air trapped in them from the conduit 28. Any residual ash that was present in the previously formed coal/oil agglomerates was left in the water. The newly formed agglomerates collected at the top of the water while the newly released ash residue collected at the bottom of the container 26.

The apparatus shown in FIG. 3 can also be used by pouring an aqueous slurry of the particulate, inorganic solids containing, coal in the container 26.

Figure 4:
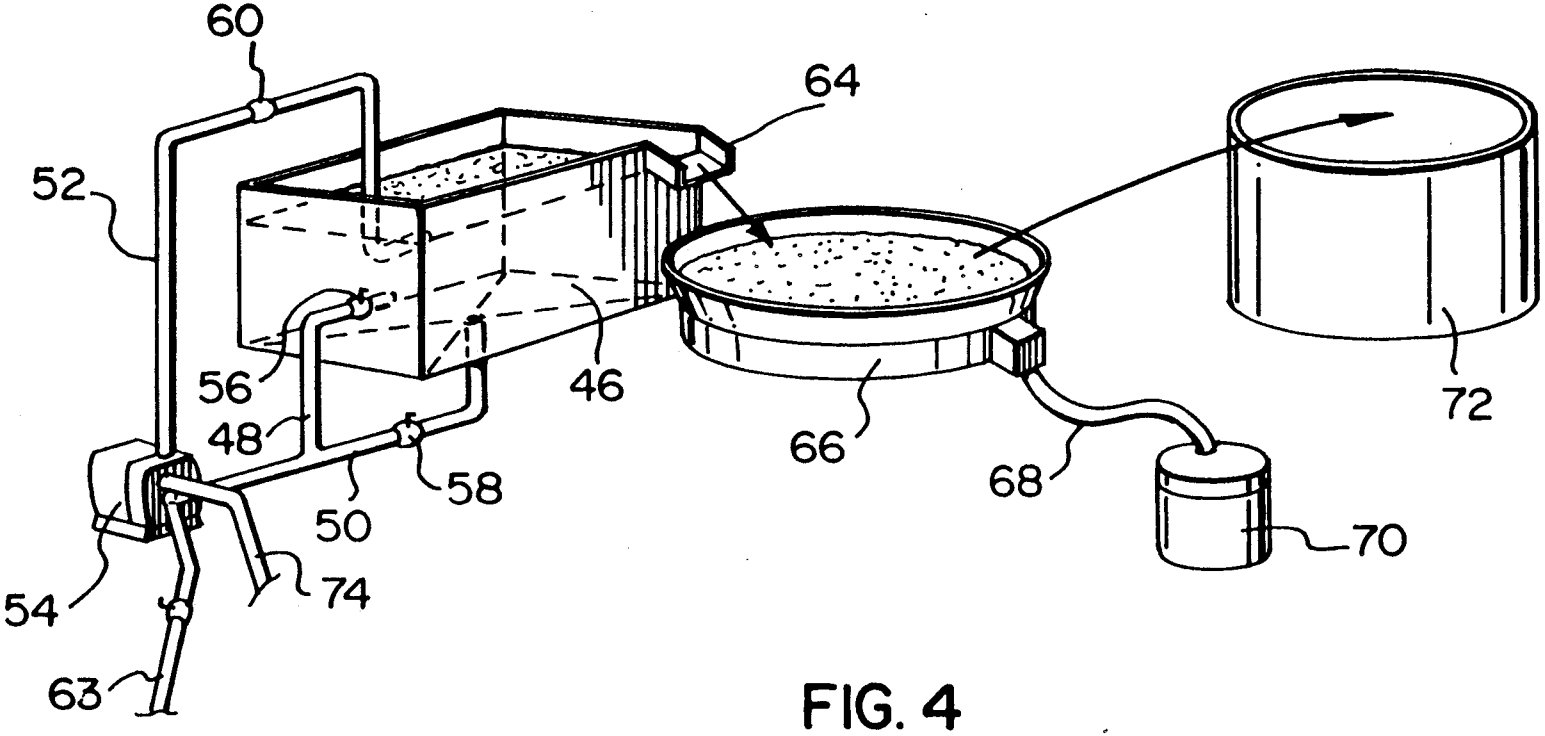
FIG. 4 is a schematic view of a more complex apparatus for separating carbonaceous components from particulate coal containing inorganic solids.

In FIG. 4 there is shown a tank 46 having outlet pipes 48 and 50 and a return pipe 52. The pipes 48 and 50 are connected to an inlet side of a centrifugal pump 54. Valves 56 and 58 are provided in the outlet pipes. The return pipe 52 is connected to the outlet from the pump 54 and contains a valve 60. An air pipe 63 is also connected to the inlet side of the pump 54. The tank 46 has an agglomerate overflow weir 64 for delivering agglomerates to a screened, dewatering vacuum filter 66 which is connected by a pipe 68 to a wet vacuum system 70. An agglomerate storage vessel 72 is provided.

In operation, previously formed agglomerates, which were produced using the conventional high shear and then low shear mixers, were poured into the tank 46 together with water and formed into a slurry. The valves 56 and 60 were opened, the pump 54 was started, and air fed to the pump along pipe 63, so that the slurry was drawn along the pipe 48 and returned aerated along the pipe 52. The aeration caused dense, wet agglomerates to form of carbonaceous components of the coal and oil and containing trapped air, which collected at the surface of the slurry and could easily be skimmed over the weir 64. Fresh water was added periodically.

Batches of the dense, wet agglomerates were spread, one after another, over the screen of the filter 66 and the vacuum system 70 was operated to dewater the agglomerates. After each batch was dried it was transferred to vessel 72 for storage.

When the formation of agglomerates diminished in the tank 46 the valve 58 was opened to pump water containing residual ash from the tank 46 along pipe 74 to a water clarifier (not shown).

The following tables give the results of tests that were carried out to verify the present invention.

Table I gives the results of tests carried out with a coal which does not easily respond to oil agglomeration. In these tests a conditioner and/or a frothing agent were found to be desirable for good recovery of the coal combustibles (which were essentially the carbonaceous components). The results of the tests given in Table I are for coal agglomerates which had been previously formed with trapped air, using the apparatus shown in FIG. 2, but which were broken down with the original water and ash and then re-formed into agglomerates using the apparatus shown in FIG. 3, and then recovered.

TABLE I

BITUMINOUS COAL TAILINGS SLURRY FROM WESTERN CANADA CONTAINING 45% WEIGHT ASH AGGLOMERATE RECOVERY PROCESS USING 3.5% WEIGHT NO. 4 FUEL OIL, WITH OXIDIZED COAL CONDITIONER AND/OR FROTHING AGENT EACH ADDED IN AMOUNTS IN THE RANGE 0.03 WEIGHT % TO 0.15 WEIGHT % BASED ON THE TOTAL SOLIDS CONTENT OF THE SLURRY

| CONDITION | Weight % Ash | AGGLOMERATES Combustibles Recovered from Coal Tailings Slurry in weight % of that originally present |
|---|---|---|
| No. 4 oil only | 13.4 | 24 |
| Conditioner + Frothing Agent | | Negligible |
| No. 4 oil + Frothing Agent | 13 | Approaching 80 |
| No. 4 oil + Conditioner | 13 | 85 Maximum |
| No. 4 oil + Conditioner + Frothing Agent | 15 | Approaching 90 |

In Tables II and III, agglomerates previously formed by the known high shear and low shear coal/oil agglomerating process of an easily oil agglomerated coal still present in the water and inorganics which were originally present in the slurry from which the agglomerates were formed, were broken down and reformed as agglomerates using the apparatus shown in FIG. 3.

In Tables II and III, d.b. is the weight of solids present in the feed, MM is the mineral matter, and Pulp is the d.b. as a weight % of the total weight of the feed.

TABLE II

FEED No. 1
Agglomerated with 1.0% #4 oil
at 30% solids and diluted
to 10% solids in low shear mixer

| | | Wt % Oil | | Product | | | | Tails | | | | | Wt % | |
|---|---|---|---|---|---|---|---|---|---|---|---|---|---|---|
| Batch | Sample | d.b. feed | d.b. prod | Wt % ash d.b. | Wt % S d.b. MM Free | Mass Yield | Comb. Rec. | Wt % ash d.b. | Wt % Ash Rej. | Wt % S d.b. MM Free | S Rej. | Wt % Ash in Feed | S in Feed MM Free | Pulp Density |
| 3 | 0-A | 1.00 | 1.57 | 13.13 | 3.74 | 63.59 | 89.35 | 81.91 | 78.13 | 27.31 | 46.54 | 38.17 | 6.25 | 10.65 |
| 3 | 30-A | 1.00 | 1.58 | 14.62 | 3.90 | 63.25 | 88.82 | 81.50 | 76.41 | 28.16 | 47.61 | 39.20 | 6.61 | 10.63 |
| 3 | 1-A | 1.00 | 1.56 | 13.47 | 3.62 | 63.96 | 89.86 | 82.67 | 77.57 | 29.20 | 47.67 | 38.41 | 6.21 | 10.34 |
| 3 | 2-A | 1.00 | 1.58 | 13.67 | 3.98 | 63.31 | 89.14 | 81.85 | 77.63 | 27.27 | 45.47 | 38.68 | 6.51 | 10.52 |
| 3 | 5-A | 1.00 | 1.55 | 14.46 | 3.32 | 64.68 | 91.24 | 84.96 | 76.24 | 34.18 | 49.71 | 39.36 | 6.02 | 10.33 |
| 3 | 10-A | 1.00 | 1.54 | 14.43 | 3.53 | 64.99 | 92.35 | 86.83 | 76.42 | 37.36 | 46.74 | 39.77 | 6.12 | 10.60 |

TABLE III

FEED No. 2
Agglomerated with 1.5% #4 oil at 30%
solids and diluted to 10% solids
in low shear mixer

| | | | Product | | | | Tails | | | | | Wt % | |
|---|---|---|---|---|---|---|---|---|---|---|---|---|---|
| Batch | Sample | Wt % Oil d.b. feed | Wt % ash d.b. | Wt % S d.b. MM Free | Mass Yield | Comb. Rec. | Wt % ash d.b. | Wt % Ash Rej. | % S d.b. MM Free | S Rej. | Wt % Ash in Feed | S in Feed MM Free | Pulp Density |
| 6 | 0-A | 1.50 | 16.09 | 3.53 | 60.36 | 88.27 | 83.02 | 77.21 | 29.80 | 52.88 | 42.62 | 6.61 | 11.01 |
| 6 | 30-A | 1.50 | 14.36 | 3.54 | 58.05 | 86.21 | 81.04 | 80.31 | 25.11 | 53.17 | 42.34 | 6.51 | 10.64 |
| 6 | 1-A | 1.50 | 15.82 | 3.64 | 54.64 | 74.43 | 65.15 | 77.37 | 11.71 | 52.53 | 38.19 | 5.70 | 12.07 |
| 6 | 2-A | 1.50 | 16.77 | 3.50 | 60.34 | 87.69 | 82.23 | 76.32 | 27.24 | 52.23 | 42.73 | 6.42 | 10.54 |
| 6 | 5-A | 1.50 | 15.52 | 3.68 | 57.44 | 86.44 | 82.12 | 79.68 | 29.59 | 55.76 | 43.86 | 7.19 | 11.46 |
| 6 | 10-A | 1.50 | 18.23 | 4.79 | 63.34 | 89.60 | 83.60 | 72.63 | 28.84 | 41.12 | 42.19 | 7.29 | 11.21 |

The tests showed that:

(i) frothing agents such as, for example, those marketed under the trademark Aerofroth 76, by Cyanamid Canada Inc., Willowdale, Ontario, Canada, and methyl isobutyl carbinol were useful additions to the slurry for nucleating air bubbles, and (ii) where clay is present, or where the coal is difficult to wet with oil (e.g. oxidized coal) a conditioning agent for increasing the oil wetability of the coal, such as, for example, the surfactant marketed under the trademark Accoal-4433, by Cyanamid Canada Inc., Willowdale, Canada were useful additions to the slurry.

The present invention provides a useful starting material for producing the water continuous phase fuel described and claimed in U.S. Pat. No. 4,601,729, dated July 22, 1986, "Aqueous Phase Continuous, Coal Fuel Slurry and a Method of its Production", Capes et al.

We claim:

1. A method of separating the carbonaceous components of coal from the non-carbonaceous inorganic solids contained in previously formed agglomerates, which agglomerates are formed by agitating a first water slurry of particulate coal and oil to form the agglomerates and then separating the so formed agglomerates from the slurry, comprising the steps of:

(1) mixing in water said previously formed agglomerates to form a second water slurry thereof;

(2) sufficiently agitating the second slurry and positively introducing a sufficient amount of air into the second slurry to:

(a) deagglomerate the previously formed agglomerates and separate the particulate coal from the inorganic solids;

(b) allow the separated particulate coal to reagglomerate into more dense and robust reagglomerates than that of the previously formed agglomerates and have reduced amount of inorganic solids therein compared with the previously formed agglomerates; and (c) entrap sufficient air in and around the reagglomerates that the reagglomerates are more buoyant than the previously formed agglomerates;

(3) allowing the reagglomerates to float to the top of the second water slurry; and (4) separating and recovering the reagglomerates with the reduced inorganic solids therein.

2. The method of claim 1 wherein during step (1) or step (2) an agglomerating oil is added.

* * * * *